US005686680A

United States Patent [19]

Laurence

[11] Patent Number: 5,686,680

[45] Date of Patent: Nov. 11, 1997

[54] PROCESS FOR THE MANUFACTURE OF MUSICAL INSTRUMENTS AND INSTRUMENTS SO OBTAINED

[76] Inventor: Pierre Laurence, 402, rue Foch, 59283 Raimbeaucourt, France

[21] Appl. No.: 492,065

[22] PCT Filed: Feb. 10, 1994

[86] PCT No.: PCT/FR94/00153

§ 371 Date: Jul. 21, 1995

§ 102(e) Date: Jul. 21, 1995

[87] PCT Pub. No.: WO94/17971

PCT Pub. Date: Aug. 18, 1994

[30] Foreign Application Priority Data

Feb. 10, 1993 [FR] France ..... 93 01476

[51] Int. Cl.[6] ..... G10D 3/00

[52] U.S. Cl. ..... 84/452 R; 524/13; 84/380 R

[58] Field of Search ..... 84/380 R, 381, 84/382, 452 R, 452 P; 524/13, 14; 428/537.5

[56] References Cited

U.S. PATENT DOCUMENTS

| | | | |
|---|---|---|---|
| 4,244,847 | 1/1981 | Posiviata et al. | 260/17.4 CL |
| 4,672,006 | 6/1987 | McGraw | 428/528 |
| 4,969,381 | 11/1990 | Decker, Jr. et al. | 84/291 |
| 5,171,616 | 12/1992 | Dejima | 428/22 |

FOREIGN PATENT DOCUMENTS

| | | |
|---|---|---|
| 0 410 553 | 1/1991 | European Pat. Off. . |
| 1 295 180 | 5/1969 | Germany . |
| 2 144 014 | 3/1973 | Germany . |
| 59064662 | 4/1984 | Japan . |
| WO 88/09986 | 12/1988 | WIPO . |

*Primary Examiner*—Michael L. Gellner
*Assistant Examiner*—Shih-yung Hsieh
*Attorney, Agent, or Firm*—Young & Thompson

[57] ABSTRACT

A process for the manufacture of a material for making a wind musical instrument and for making the instrument includes the steps of providing a wood powder, incorporating into the powder fibers chosen to adjust the modulus of elasticity of the mixture to the desired value for the instrument, placing the mixture into a heated mold to melt the natural resins in the wood while maintaining the mixture under pressure between $50\times10^5$ Pa and $700\times10^5$ Pa, and cooling the mixture under the pressure.

13 Claims, 1 Drawing Sheet

PROCESS FOR THE MANUFACTURE OF MUSICAL INSTRUMENTS AND INSTRUMENTS SO OBTAINED

The present invention relates to a process for the manufacture of a material intended to constitute a blank of a musical instrument and in particular of a wind instrument such as for example a clarinet or oboe. It also concerns musical instruments and materials adapted to constitute a blank therefor.

In order to produce quality wind instruments, manufacture thereof traditionally makes use of woods constituted by rare essences such as rosewood or more particularly ebony. Such woods are chosen by reason, on the one hand, of their acoustic qualities but also by reason of their solidity and hardness, which render them suitable for undergoing the mechanical machinings necessitated by the fact that they must support the different control mechanisms of the instrument.

At the present time, manufacturers of wind instruments are finding it increasingly difficult to obtain high quality woods, on the one hand, due to the impoverishment of the natural resources and, on the other hand, due to the various legislations governing the distribution of the woods of rare essences.

It has therefore been sought to create substitute materials which may be exploited on an industrial scale and which present the same qualities as the traditional materials from the standpoint of acoustics, mechanical characteristics and outer aspect, both tactile and visual. It has thus been proposed to produce wind instruments in materials such as synthetic resins. This choice made it possible to have available materials of which the various mechanical characteristics such as density, hardness and resilience, were controlled perfectly. Consequently, it was thus proposed to improve both the character of reproducibility of the material used and its cost price, at the same time. Unfortunately, due to the low acoustic qualities of the wind instruments thus obtained, the latter hays been reserved for minor uses, so that high quality instruments are still manufactured at present in traditional materials.

It is also known that, in traditional instrument-making, and despite the cost and difficulties in supply of woods of rare essences, only about twenty per cent of the basic material constituting the blank are used, the remaining eighty per cent being eliminated in the form of chips or various waste.

Furthermore, although the traditional wind instruments present an excellent resistance to longitudinal stresses, this, unfortunately, does not apply to the transverse stresses and these same instruments are then extremely fragile.

It is an object of the present invention to overcome these drawbacks by proposing a process for producing a material from which musical instruments and in particular wind instruments may be manufactured, in totally traditional manner, which present acoustic qualities quite comparable to those of traditional, very high quality instruments, this process using, as basic material, what usually constitutes the machining waste of traditional instruments. Moreover, this process proposes to improve, in particularly noteworthy manner, the resistance to transverse mechanical stresses undergone by the instrument.

The present invention thus has for its object a process for the manufacture of a material intended for producing a musical instrument and particularly a wind instrument, characterized in that it comprises the steps consisting in:

—making a powder constituted by at least one type of wood,

—incorporating in said wood powder discontinuous fibers and particularly short fibers, these fibers being chosen so that, by playing on their nature and quantity, the modulus of elasticity of the material is adjusted to the value desired for the instrument, —disposing the mixture of wood powder and fibers thus obtained in a mould where it is heated to a sufficient temperature to melt the natural resins contained in the wood, while maintaining it under a pressure included between $50.10^5$ Pa and $700.10^5$ Pa as a function of the density which it is desired to obtain for the instrument, —cooling the mixture, maintaining said pressure at least during the beginning of cooling.

The process according to the invention procures substantial savings since it makes it possible to use, as basic material, on the one hand, the chips and other residues coming from traditional machining of the wind instruments and, on the other hand, blocks of precious wood of quality but of which the characteristics, and particularly the dimensional characteristics, are insufficient to constitute such or such part of an instrument.

The process of the invention also makes it possible to produce a basic material intended to constitute a musical instrument which is perfectly isotropic, as shown by the equality of the transverse and longitudinal moduli of elasticity obtained, this value of the modulus of elasticity being able to be adjusted to a desired value by playing on the nature and quantity of discontinuous fibers mixed with the wood powder. The process also makes it possible to adjust the density of said material by playing on the level of the compression applied to the mixture during the heating step.

In a particularly interesting embodiment of the invention, a fiber-less pre-blank, or "core", is firstly produced, which is then coated with a material provided with fibers, or "skin". According to this embodiment of the invention, a "core" is thus constituted by carrying out the steps consisting in:

—making a powder constituted by at least one type of wood,

—disposing it in a mould where it is heated to a sufficient temperature to melt the natural resins contained in the wood, while maintaining it under a pressure included between $50.10^5$ Pa and $700.10^5$ Pa, as a function of the density which it is desired to obtain for the core, —cooling the core, while maintaining said pressure at least during the beginning of cooling, —demoulding the core, placing it in a mould and disposing therearound the mixture mentioned above, so as to constitute a "skin", —heating the assembly constituted by the core and the skin to a temperature sufficient to melt the natural resins contained in the pulverulent wood, while maintaining it under a pressure included between $50.10^5$ Pa and $700.10^5$ Pa, as a function of the density which it is desired to obtain, —cooling the assembly while maintaining said pressure at least during the beginning of cooling.

In an embodiment of the invention, when the instrument comprises a hollowed central part, there is constituted, in the course of the step of moulding of the core, a reserve at the centre thereof, corresponding substantially to the hollowed central part of the instrument. Such an arrangement makes it possible to eliminate the operation of axial drilling of the latter which is usually delicate and costly to effect. The central hollow may be made by using a mould provided with a retractable mobile central core. Although this hollow is preferably formed at a dimension smaller than its final value on the terminated instrument, so as to be able to tune the latter to the desired timbre by means of reamers, as is done in accordance with traditional techniques, it may also be formed directly at its final dimensions.

The present invention therefore makes it possible to constitute blanks which are, on the one hand, easily machinable with a reamer, due to the low relative hardness of the core and, which, on the other hand, are particularly resistant to stresses and particularly to the torsional and bending stresses to which wind instruments are usually subjected.

It will also be noted that the production of the core by moulding makes it possible to obtain a perfectly centred central hollow which ensures an efficient guiding of the reamers. Furthermore, it is known that these latter are usually made of mild steels, so that they cannot be used for machining materials of great hardness. The present invention makes it possible to produce wind instruments adapted to be adjusted by means of conventional mild-steel reamers and which nonetheless present qualities of mechanical strength at least equal to those of traditional instruments.

The present invention also has for an object a material, called basic material, intended to constitute the blank from which at least a part of a musical instrument, and particularly a wind instrument, is machined, characterized in that it is constituted by a mixture of a powder, in the compressed state, of at least one type of wood with discontinuous fibers and in particular short fibers.

In an embodiment of the invention, the basic material intended, after machining, to constitute at least a part of a musical instrument and particularly a wind instrument, is characterized in that it is constituted:

—by a central part, or "core", constituted by a compressed powder of at least one type of wood, —by an outer part, or "skin", surrounding the core, constituted by a mixture in the compressed state of a powder of at least one type of wood with discontinuous fibers, and in particular short fibers, the modulus of elasticity of the skin being greater than that of the core.

The present invention also has for an object a musical instrument, and particularly a wind instrument, made from the basic material mentioned hereinabove.

An embodiment of the present invention will be described hereinafter by way of non-limiting example with reference to the accompanying drawing, in which.

Figure 1:
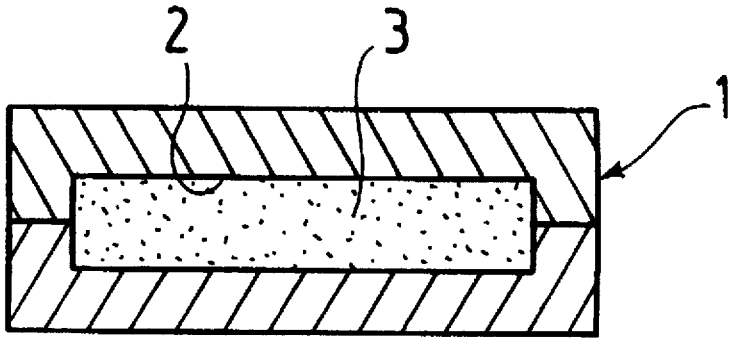
FIG. 1 is a schematic view in vertical section illustrating the step of moulding a core of a blank of a body of a wind instrument made according to the invention.
Figure 2:
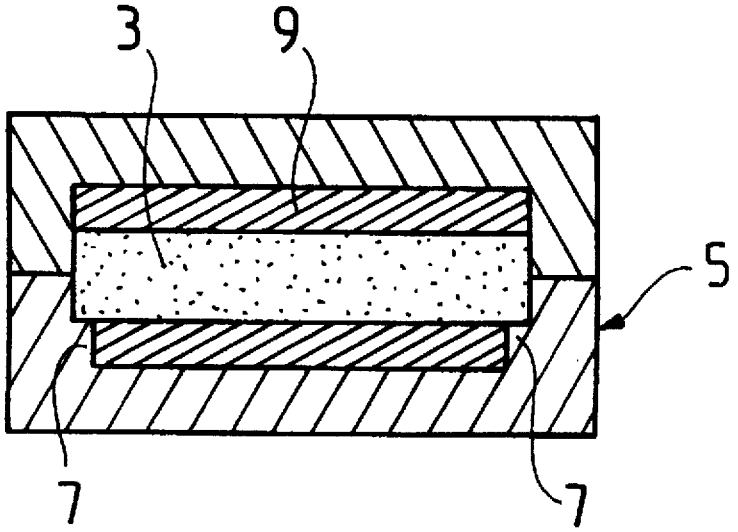
FIG. 2 is a schematic view in vertical section of the step illustrating the moulding of a skin around the core formed in the course of the moulding step illustrated in FIG. 1.

A first embodiment of the process according to the invention, applied to the manufacture of a blank of a clarinet body made of ebony will firstly be described.

The basic material of this clarinet body is constituted two kilos of ebony waste, coming for example from the chips remaining after the conventional manufacture of wind instruments. This waste is dried, under controlled conditions of hygrometry lower than 5%, then subjected to sifting (5/10 sieve) in order to eliminate the impurities thereof. The waste is then crushed so as to obtain a pulverulent wood reduced to the state of "flour".

As a function of the instrument which it is desired to obtain, and particularly its colour, one wood or, on the contrary, a mixture of woods of different natures may be used.

There are then mixed with the pulverulent wood 50 grams of carbon fibers from which the impurities that they might contain were possibly removed beforehand by cleaning them, for example by incineration, heating them to a high temperature, of the order of 500° C. The carbon fibers are then crushed and graded to a length of less than five centimeters, preferably included between about 2 mm and 10 mm and, more precisely in the present example, to a length of 3 mm, so as to constitute discontinuous, short fibers which may be mixed uniformly with the wood powder.

In order to produce a good homogeneity of the powder/fiber mixture, these fibers are separated, prior to the mixture, by adding thereto a viscous, so-called "loosening" product. Applicant has successfully used two types of loosening products.

A first type of loosening product is constituted by products which, after having performed their function of loosening agent, may be eliminated at least in part for example by evaporation. Applicant has thus obtained good results by using, as loosening product, wallpaper size based on carboxymethylcellulose, of which the water that it contains has been eliminated by evaporation, once the mixture of the fibers and the wood powder has been effected.

A second type of loosening product is constituted by products which, on the contrary, after having performed their function of loosening agent, remain within the mixture, but in a form which does not affect the mechanical qualities of the final blank. Applicant has thus used resins which, after their action of loosening the fibers, are hardened, so that their presence is not detrimental to the characteristics of the final product.

In the present embodiment of the invention, it has been chosen to use a loosening product constituted by wallpaper size and, after mixture with the ebony powder in a mixer, for example of the kneader type, the mixture has been dried in order to eliminate the water contained therein.

The mixture obtained is then disposed in a mould where it is subjected to a pressure of $200.10^5$ Pa for fifteen minutes at a temperature of 150° C., sufficient to produce fusion of the natural resins contained in the ebony powder and to allow a good diffusion of these resins in the mixture. After having left the whole to cool to a temperature of about 90° C., maintaining it under pressure during this cooling, it is demoulded and the blank of the clarinet body is obtained. The following Table shows some mechanical parameters of the blank of the clarinet body obtained and of a sample of ebony, of the type used in conventional instrument-making.

| | Mean density | Hardness (Brinell) | Longitudinal modulus of elasticity | Transverse Modulus of elasticity |
|---|---|---|---|---|
| Natural ebony | 1.2 | 22.6 | 1400 daN/mm² | 700 daN/mm² |
| Material according to the invention | 1.2 | 35.6 | 900 daN/mm² | 900 daN/mm² |

These results show that the invention makes it possible to improve the isotropic character of the material constituting the instrument. In fact, it is observed from the Table that the longitudinal modulus of elasticity of the material according to the invention is clearly less than that of natural ebony, which is not detrimental insofar as, on the one hand, it can be increased up to the value of the latter (by acting on the nature of the fibers and on their quantity) and, on the other hand, as the value obtained is quite sufficient, since the principal stresses undergone by the instrument are not longitudinal stresses but transverse stresses. It is also observed that the invention makes it possible considerably to increase the transverse modulus of elasticity of the material, thus giving the instrument a resistance which those of the prior art did not present.

The product obtained is thus perfectly adapted to constitute, from the mechanical standpoint but also from the aesthetic and tactile standpoint, a material or a blank from which a clarinet body will be machined. Of course, the other pieces of the clarinet may be obtained in accordance with an identical modus operandi.

Other fibers may also be used, capable of modifying the hardness and/or the modulus of elasticity of the material constituting the blank, so as to be able to adjust the modulus of elasticity of the latter to a desired value, as a function of the nature of the instrument which it is desired to produce. Among the fibers having given good results for increasing the modulus of elasticity of the material obtained and apart from the carbon fibers already mentioned, aramid fibers (marketed in particular under the Registered Trademark "KEVLAR"), glass fibers and cellulose fibers may be retained.

In one embodiment of the invention, use is made of a mould provided with a mobile core retractable after moulding, which makes it possible to form the central orifice of the body of the instrument directly, from moulding.

The present invention also presents the advantage of making it possible to control without difficulty the density of the basic material and therefore that of the instrument which will be cut therein, by playing on the granulometry of the wood powder used and the rate of compression applied. By controlling the density of the basic material, its parameter of isotropy is also controlled, so that it is thus possible to use, for making certain musical instruments, and particularly clarinets, woods which, like for example iroko or red cedar, could up to the present time not be used by reason on the one hand of their densities too different from that of conventional instruments and, on the other hand, of their too anisotropic character.

Applicant has established that, in the domain of wind instruments, the compression rates were advantageously included between $50.10^5$ Pa and $500.10^5$ Pa. However, in other domains of musical instruments such as for example percussion instruments, the compression rate will be higher, for example of the order of $700.10^5$ Pa.

In order to improve the mechanical resistance and particularly the bending strength of the instrument, the process for manufacturing the basic material or the blank is carried out in two steps, namely a first step during which the central part, or core, of the instrument is made, this central part being constituted by a material easy to machine, and a second step during which the core is coated with an outer coating, or skin, of which the mechanical qualities, and in particular the hardness and modulus of elasticity, are greater than those of the core.

As shown in FIG. 1, in order to constitute the core, or pre-blank, of the piece, there is disposed in the hollow 2 of a mould 1, called pre-blank mould, wood in pulverulent form, which is subjected to conditions of pressure and of temperature identical to those mentioned hereinabove. The shape and dimensions of the hollow 2 of the mould 1 are such that a core 3 is thus obtained whose outer dimensions are sufficient to allow the central bore to be subsequently made and the instrument adjusted.

The core 3 is then disposed in another mould 5, called blank mould, in which it abuts for example on bosses 7 located at its ends, so that its periphery is freed. The free parts of the mould 5 are then filled with a mixture of wood in pulverulent form and of carbon fibers, this mix being prepared as set forth hereinabove, then the whole is taken to a temperature of about 150° C. under a pressure of about $200.10^5$ Pa for a duration of about 10 to 15 minutes so as to provoke fusion of the natural resins contained in the wood.

Figure 3:
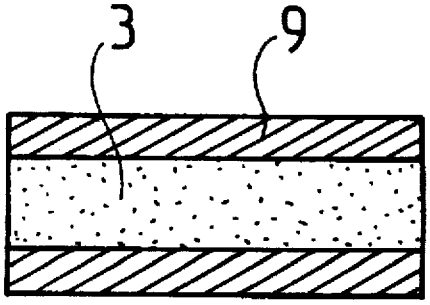
FIG. 3 is a schematic view in section of a blank of a body of a wind instrument made according to the invention.

During this "baking under pressure", an interpenetration of the core and the skin is provoked, such that these two elements tend to behave thereafter like a single piece. The assembly constituted by the core 3 and the skin 9 is then cooled, while maintaining the pressure applied until its temperature descends to below a certain threshold, for example 90° C., then the blank is demoulded. The latter therefore comprises, as shown in FIG. 3, an outer skin 9 presenting remarkable mechanical qualities and appearance, and a core 3 which, after drilling, is adapted to be "adjusted" without any difficulty with a traditional reamer, and whose qualities are such that they give the finished instrument acoustic qualities which are identical to and even greater than those of traditional instruments.

As mentioned hereinbefore, a resin of epoxy type, such as the one marketed by the firm SHELL under reference epikote 828, may also be used as loosening product. Once the mixture is effected, there may be added thereto a product enabling it to be fixed.

It is thus possible, in the case of the finished instrument having to comprise a hollowed central part, to constitute, during the moulding step, a reserve at the centre of the blank, or core, so as to form said hollowed central part on the instrument, from moulding. Although the invention is particularly advantageous for constituting blanks in which the various pieces of an instrument will then be cut, in accordance with techniques of the type used in traditional instrument-making, it also makes it possible to obtain these different pieces directly by moulding, which represents a considerable saving in the cost price of the instrument.

In the case of the instrument being constituted by a plurality of pieces, particularly tubular pieces, which are assembled in one another by fitting, and in order to compensate the fragility created by the reduction of matter necessary for effecting the fit, a greater density of short or long fibers, oriented or not, is disposed in those zones where the fits are made.

This form of embodiment of the invention makes it possible to overcome a shortcoming inherent in musical instruments made of wood in accordance with traditional methods, namely a lack of resistance at the join of two fitted pieces.

I claim:

1. Process for the manufacture of a material intended for producing a musical instrument and particularly a wind instrument, comprising the steps of:

—making a powder constituted by at least one type of wood,

—incorporating in said wood powder fibers chosen so that, by playing on their nature and quantity, the modulus of elasticity of the material is adjusted to the value desired for the instrument, —disposing a mixture of said wood powder and said fibers thus obtained in a mold where it is heated to a sufficient temperature to melt the natural resins contained in the wood, while maintaining it under a pressure included between $50.10^5$ Pa and $700.10^5$ Pa as a function of the density which it is desired to obtain for the instrument, —cooling the mixture, maintaining said pressure at least during the beginning of cooling.

2. The process according to claim 1 characterized in that, prior to mixing the fibers with the pulverulent wood, the fibers are loosened by mixing them with a loosening product.

3. The process according to claim 2, characterized in that the loosening product is a viscous product and in particular a resin.

4. The process according to claim 3, characterized in that the loosening product is eliminated at least in part once the mixture of the fibers with the pulverulent wood has been effected.

5. The process according to claim 1 in which the instrument comprises a hollowed central part, characterized in that, during the moulding step, a reserve is constituted at the centre of the blank or of the core so as to form by moulding, on the instrument, said hollowed central part.

6. A process for forming a pre-blank, or core comprising the steps of:

making a powder constituted by at least one type of wood,

—disposing it in a mold where it is heated to a sufficient temperature to melt the natural resins contained in the wood, while maintaining it under a pressure included between $50.10^5$ Pa and $700.19^5$ Pa as a function of the density which it is desired to obtain for the core, —cooling the core, while maintaining said pressure at least during the beginning of cooling, —demolding the core, the core, placing it in a further mold and disposing therearound said mixture, so as to constitute a skin, —heating an assembly constituted by the core and the skin to a temperature sufficient to melt the natural resins contained in the pulverulent wood, while maintaining it under a pressure included between $50.10^5$ Pa and $700.10^5$ Pa as a function of the density which it is desired to obtain, —cooling the assembly while maintaining said pressure at least during the beginning of cooling.

7. A blank intended to constitute a musical instrument and in particular a wind instrument, comprising a mixture, in a compressed state, of a powder of at least one wood with discontinuous fibers, and in particular short fibers, a natural resin of said at least one wood being a binder and the only binder of said blank, said blank further comprising:

a central part, or core (3), constituted by a powder of at least one wood in the compressed state, an outer part, or skin (9), surrounding the core (3), constituted by a mixture of a powder of at least one type of wood in the compressed state with discontinuous fibers, and in particular short fibers, the modulus of elasticity of the skin (9) being greater than that of the core (3).

8. A musical instrument, and particularly wind instrument, comprising a mixture, in the compressed state, of a powder of at least one type of wood with discontinuous fibers, a natural resin of said at least one wood being a binder and the only binder of said at least one of its pieces, said instrument further comprising:

a central part, or core (3), constituted by a powder of at least one type of wood in the compressed state, an outer part, or skin (9), surrounding the core (3), constituted by a mixture in the compressed state of a powder of at least one type of wood and fibers, the modulus of elasticity of the skin (9) being greater than that of the core (3).

9. The instrument according to claim 8, characterized in that the wood constituting the skin (9) is the same as that constituting the core (3).

10. The instrument according to claim 8, characterized in that the fibers are carbon fibers.

11. The instrument according to claim 8, characterized in that said fibers have a length less than five centimeters.

12. The instrument according to claim 8, comprising a plurality of tubular pieces, assembled in one another by fit, wherein zones close to said fits comprise a higher density of said fibers than other zones of the instrument.

13. A musical instrument, and particularly a wind instrument, comprising a mixture, in the compressed state, of a powder of at least one type of wood with discontinuous fibers, a natural resin of said at least one wood being a binder and the only binder of said at least one of its pieces, said instrument further comprising a plurality of pieces, particularly tubular pieces, assembled in one another by fit, wherein zones close to said fits comprise a higher density of said fibers than other zones of the instrument.

* * * * *